US007797925B2

(12) United States Patent
Kawamura et al.

(10) Patent No.: US 7,797,925 B2
(45) Date of Patent: Sep. 21, 2010

(54) EXHAUST GAS PURIFYING SYSTEM FOR INTERNAL COMBUSTION ENGINE

(75) Inventors: Jun Kawamura, Chita-gun (JP); Masakuni Yokoyama, Tokai (JP)

(73) Assignee: DENSO CORPORATION, Kariya (JP)

( * ) Notice: Subject to any disclaimer, the term of this patent is extended or adjusted under 35 U.S.C. 154(b) by 886 days.

(21) Appl. No.: 11/638,408

(22) Filed: Dec. 14, 2006

(65) Prior Publication Data

US 2007/0137183 A1 Jun. 21, 2007

(30) Foreign Application Priority Data

Dec. 20, 2005 (JP) ..... 2005-366008

(51) Int. Cl.
*F01N 3/00* (2006.01)

(52) U.S. Cl. ..... 60/277; 60/295; 60/301; 60/273

(58) Field of Classification Search ..... 60/277, 60/274, 276, 295, 301
See application file for complete search history.

(56) References Cited

U.S. PATENT DOCUMENTS 6,216,451 B1 * 4/2001 Schnaibel et al. ..... 60/277
6,244,046 B1 6/2001 Yamashita
2005/0132698 A1 * 6/2005 Nagaoka et al. ..... 60/295
2005/0172615 A1 * 8/2005 Mahr ..... 60/286

FOREIGN PATENT DOCUMENTS

| | | |
|---|---|---|
| EP | 1 225 323 | 7/2002 |
| JP | 2002-155735 | 5/2002 |
| JP | 2003-214240 | 7/2003 |

OTHER PUBLICATIONS

Japanese Office Action dated Jan. 19, 2010, issued in corresponding Japanese Application No. 2005-366008, with English translation.

* cited by examiner

*Primary Examiner*—Thomas E Denion
*Assistant Examiner*—Jesse Bogue
(74) *Attorney, Agent, or Firm*—Nixon & Vanderhye P.C.

(57) ABSTRACT

An NOx catalytic converter, which includes an NOx storage and reduction catalyst, absorbs NOx contained in exhaust gas of an engine. The absorbed NOx is deoxidized and eliminated when an NOx deoxidizing agent is supplied to the catalytic converter. An ECU determines a purifying performance of the catalytic converter based on one of an amount of supplied NOx deoxidizing agent, which is required to deoxidize and remove absorbed NOx at the NOx catalytic converter, and a parameter that correlates with the amount of the supplied NOx deoxidizing agent. The ECU prohibits the determining of the purifying performance of the catalytic converter when it is determined that supplied unburnt fuel, which is supplied to the catalytic converter, is in an excessive state.

18 Claims, 6 Drawing Sheets

EXHAUST GAS PURIFYING SYSTEM FOR INTERNAL COMBUSTION ENGINE

CROSS REFERENCE TO RELATED APPLICATION

This application is based on and incorporates herein by reference Japanese Patent Application No. 2005-366008 filed on Dec. 20, 2005.

BACKGROUND OF THE INVENTION

1. Field of the Invention

The present invention relates to an exhaust gas purifying system for an internal combustion engine.

2. Description of Related Art

In an internal combustion engine, such as a diesel engine, when lean burn combustion takes place, NOx (nitrogen oxide) is exhausted into the air. It has been proposed to provide an NOx storage and reduction (deoxidization) catalytic converter (hereinafter referred to as "NOx catalytic converter"), which includes an NOx storage and reduction (deoxidization) catalyst, in an exhaust system of a vehicle to purify NOx contained in the exhaust gas. The NOx catalytic converter absorbs NOx contained in the exhaust gas when an air/fuel ratio of the exhaust gas is in a lean range. The NOx catalytic converter deoxidizes (reduces) and removes its absorbed NOx with aid of NOx deoxidizing agent (reducing agent), such as HC and CO, when the air/fuel ratio of the exhaust gas is in a rich range.

When the amount of the absorbed NOx in the NOx catalytic converter reaches a saturation range and thereby reaches its absorbable limit, the NOx purifying performance of the NOx catalytic converter decreases. Thus, an NOx deoxidization control operation for deoxidizing and removing the absorbed NOx of the NOx catalytic converter is performed to limit the decrease of the NOx purifying performance of the NOx catalytic converter. Specifically, rich combustion is temporarily performed in the internal combustion engine, so that the deoxidizing agent, such as HC and CO, contained in the exhaust gas produced at the time of the rich combustion is supplied to the NOx catalytic converter to deoxidize and remove the absorbed NOx at the NOx catalytic converter. This technique is generally referred to as "rich purge" or "rich spike".

When the internal combustion engine is used for a long period of time, sulfur components contained in the fuel are absorbed and accumulated by the NOx catalytic converter. This phenomenon is called as "sulfur poisoning". The sulfur poisoning significantly decreases the purifying performance of the NOx catalytic converter. In view of this, there has been proposed a technique for determining the decrease in the purifying performance of the NOx catalytic converter at the time of executing the rich purge. For example, an oxygen concentration sensor is provided on a downstream side of the NOx catalytic converter, and the purifying performance of the NOx catalytic converter is determined based on a measurement of the oxygen concentration sensor (see, for example, Japanese Unexamined Patent Publication No. 2000-34946, which corresponds to U.S. Pat. No. 6,244,046). That is, at the time of performing the rich purge, when the deoxidization of the absorbed NOx is completed in the NOx catalytic converter, the air/fuel ratio on the downstream side of the NOx catalytic converter is shifted into the rich range, and this shift is sensed with the oxygen concentration sensor to determine the completion of the NOx deoxidization in the NOx catalytic converter. In this case, when the NOx purifying performance of the NOx catalytic converter decreases, i.e., when the absorbable amount of NOx decreases, the timing of shifting in the air/fuel ratio into the rich range is advanced. Therefore, it is possible to determine the decrease in the purifying performance, i.e., catalyst deterioration of the NOx catalytic converter based on the required time period, which is required to shift the air/fuel ratio into the rich range on the downstream side of the NOx catalytic converter.

Furthermore, besides the rich purge described above, there is also known another technique for deoxidizing and removing the absorbed NOx at the NOx catalytic converter. In this technique, unburnt fuel (HC), which serves as deoxidizing agent, is supplied to the NOx catalytic converter through a fuel adding valve that is provided to the exhaust pipe. This technique is advantageous in the case where the increase in the injection quantity of fuel into the cylinders of the internal combustion is not desirable. However, when the fuel is directly supplied from the fuel adding valve into the exhaust pipe, only the concentration of HC, which serves as the deoxidizing agent, in the NOx catalytic converter becomes excessively high. In this excessive state of HC, the result of the purifying performance determining operation, which is performed at the time of the NOx deoxidization control operation, may possibly become erroneous.

SUMMARY OF THE INVENTION

The present invention addresses the above disadvantage. Thus, it is an objective of the present invention to provide an exhaust gas purifying system for an internal combustion engine capable of effectively limiting occurrence of an erroneous determination of a purifying performance of a catalytic converter provided in the exhaust gas purifying system.

To achieve the objective of the present invention, there is provided an exhaust gas purifying system for an internal combustion engine. The exhaust gas purifying system includes an NOx catalytic converter, an NOx deoxidization control means, a purifying performance determining means, an unburnt fuel state determining means and a prohibiting means. The NOx catalytic converter includes an NOx storage and reduction catalyst and is provided in an exhaust system of the internal combustion engine. The NOx deoxidization control means is for supplying and controlling an NOx deoxidizing agent to the NOx catalytic converter at a time of deoxidizing and removing absorbed NOx, which is absorbed by the NOx storage and reduction catalyst. The purifying performance determining means is for determining a purifying performance of the catalytic converter based on one of an amount of the supplied NOx deoxidizing agent, which is required to deoxidize and remove the absorbed NOx at a time of operating the NOx deoxidization control means, and a parameter that correlates with the amount of the supplied NOx deoxidizing agent. The unburnt fuel state determining means is for determining whether supplied unburnt fuel, which is supplied to the NOx catalytic converter, is in an excessive state at the time of operating the NOx deoxidization control means. The prohibiting means is for prohibiting the purifying performance determining means from determining the purifying performance of the catalytic converter when the unburnt fuel state determining means determines that the supplied unburnt fuel is in the excessive state.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to the accompanying drawings. In the following embodiment, the present invention is implemented in a vehicle having a diesel engine (an internal combustion engine), which serves as a drive source of the vehicle. In the following description, an engine system of the vehicle will be schematically described.

Figure 1:
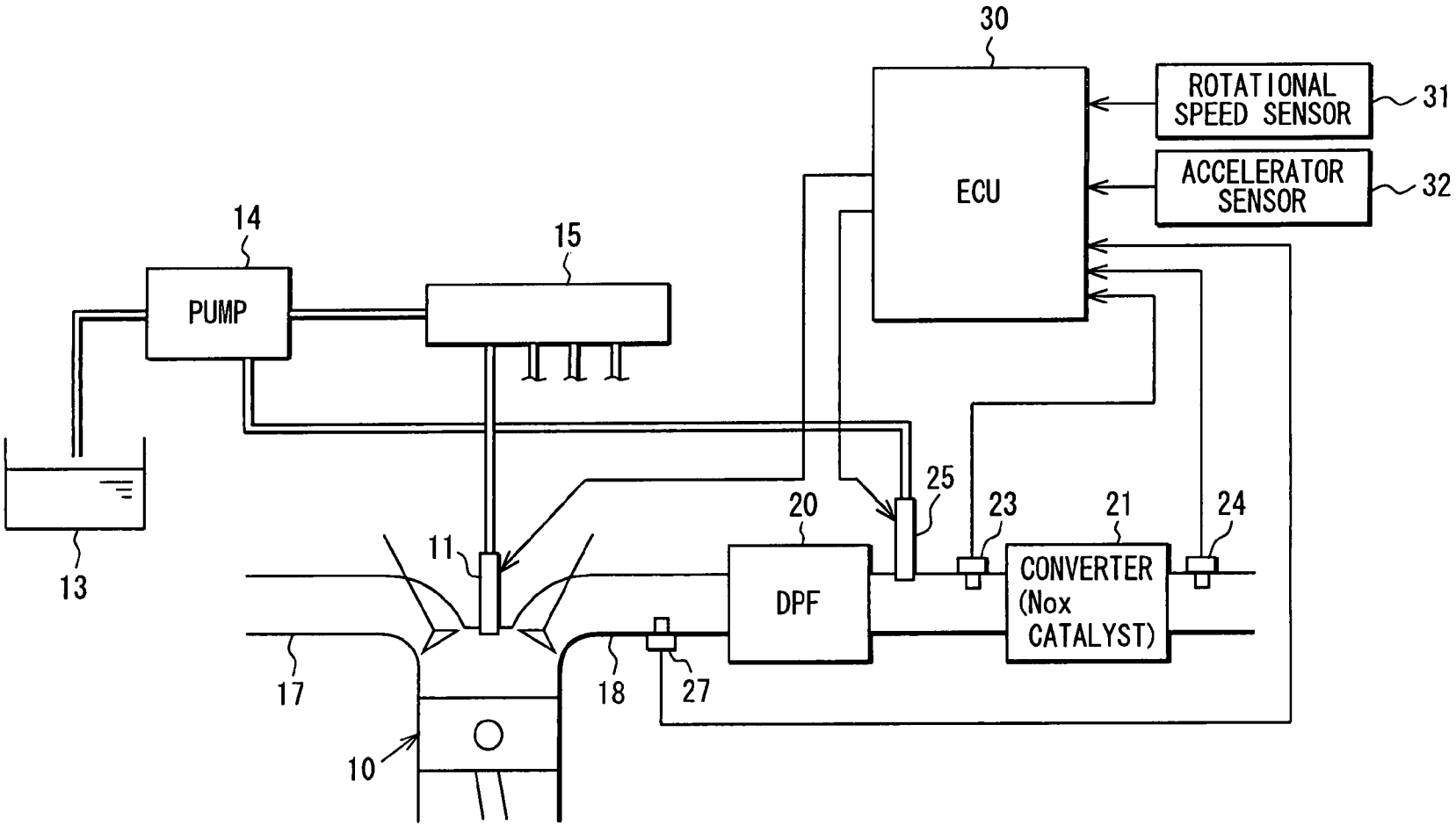
FIG. 1 is a diagram schematically showing a structure of an engine system according to an embodiment of the present invention.

In FIG. 1, solenoid type injectors 11 (only one is depicted in FIG. 1) are provided to cylinders, respectively, of the engine 10. Fuel is injected from the injectors 11 according to a predetermined combustion sequence. A common rail type fuel supply system is used in a fuel supply system of the present engine system. A high pressure pump 14 takes fuel from a fuel tank 13 and pumps the fuel to a common rail 15. The fuel in the common rail 15 is kept in the high pressure state through the pumping of the fuel from the high pressure pump 14. The high pressure fuel in the common rail 15 is supplied to each injector 11, and the fuel is injected into the corresponding cylinder of the engine through valve opening of the injector 11. Furthermore, an air intake pipe 17 and an exhaust pipe 18 are connected to the engine 10. Air is supplied to each cylinder of the engine 10 through the air intake pipe 17, and the exhaust gas is outputted from each cylinder through the exhaust pipe (exhaust system) 18 upon combustion of the fuel in the cylinder.

A diesel particulate filter (DPF) 20 and an NOx storage and reduction catalytic converter (hereinafter referred to as NOx catalytic converter) 21 are provided in the exhaust pipe 18 to form a post combustion processing system to purify the exhaust gas. Specifically, the DPF 20 collects particulate matter (PM) contained in the exhaust gas, and the NOx catalytic converter 21 includes an NOx storage and reduction catalyst (NSRC) to purify NOx contained in the exhaust gas. According to the present embodiment, the DPF 20 is provided at an upstream part of the exhaust pipe 18, and the NOx catalytic converter 21 is provided at a downstream part of the exhaust pipe 18. Here, it should be noted that the position of the DPF 20 and the position of the NOx catalytic converter 21 may be reversed such that the DPF 20 is provided at the downstream part of the exhaust pipe 18, and the NOx catalytic converter 21 is provided at the upstream part of the exhaust pipe 18. The DPF 20 and the NOx catalytic converter 21 may be integrated into a single purifying device, which is provided in the exhaust pipe 18. Furthermore, an oxidation catalytic converter may be provided on the downstream side of the NOx catalytic converter.

As is well known in the art, at the time of lean burn combustion, the catalyst in the NOx catalytic converter 21 absorbs NOx contained in the exhaust gas. Then, at the time of rich burn combustion, the absorbed NOx is deoxidized (reduced) and removed at the catalyst of the NOx catalytic converter 21 by using HC and CO contained in the exhaust gas.

An A/F sensor 23 is provided on an upstream side of the NOx catalytic converter 21, and an A/F sensor 24 is provided on a downstream side of the NOx catalytic converter 21. Each A/F sensor 23, 24 is formed as an oxygen concentration sensor, which outputs an oxygen concentration measurement signal that corresponds to an oxygen concentration in the exhaust gas. An air/fuel ratio is computed based on the oxygen concentration measurement signal. In place of each A/F sensor 23, 24, it is possible to provide an oxygen ($O_2$) sensor, which outputs a corresponding electromotive force based on whether the exhaust gas is rich or lean.

Furthermore, an electromagnetic fuel adding valve 25 is provided on an upstream side of the NOx catalytic converter 21 between the DPF 20 and the NOx catalytic converter 21 in the exhaust pipe 18 to add fuel into the exhaust gas in the exhaust pipe 18 and thereby to supply the fuel to the NOx catalytic converter 21. A portion of the low pressure fuel, which is taken from the fuel tank 13 by the high pressure pump 14, is supplied to the fuel adding valve 25, so that the fuel is added from the fuel adding valve 25 into the exhaust pipe 18 through the valve opening process in the fuel adding valve 25. Here, it should be noted that the position of the fuel adding valve 25 may be on the upstream side of the DPF 20. In addition, an exhaust temperature sensor 27 is provided on the upstream side (or on the downstream side) of the DPF 20 in the exhaust pipe 18 to sense the temperature of the exhaust gas.

An ECU 30 is an electronic control unit, which includes a known microcomputer that has a CPU, a ROM, a RAM, an EEPROM and the like. Measurement signals are supplied to the ECU 30 from various sensors, such as the A/F sensors 23, 24, the exhaust temperature sensor 27, a rotational speed sensor 31 and an accelerator sensor 32. The rotational speed sensor 31 senses a rotational speed of the engine, and the accelerator sensor 32 senses an operational amount of an accelerator by a driver. The ECU 30 executes various control programs, which are stored in the ROM, to perform, for example, a fuel injection operation of each injector 11 according to an engine operational state. That is, the ECU 30 determines the best fuel injection quantity and fuel injection timing based on the engine operational information, which includes the engine rotational speed and the accelerator operational amount. Then, the ECU 30 drives each injector 11 based on an injection control signal, which corresponds to the thus determined best fuel injection quantity and fuel injection timing.

In the case of the common rail type fuel supply system, a fuel pressure feedback control operation of the high pressure pump 14 is performed such that the fuel pressure in the common rail 15 coincides with a target value. However, such a fuel pressure feedback control operation does not constitute a main part of the present invention and therefore will not be described in detail.

Furthermore, whenever a predetermined condition is satisfied, the ECU 30 performs an NOx deoxidization control operation for deoxidizing and removing the absorbed NOx at the NOx catalytic converter 21 to recover the NOx absorbing performance of the NOx catalytic converter 21. In the present embodiment, the NOx deoxidization control operation is performed in one of the following two ways (1), (2).

(1) A rich purge control operation may be performed to temporarily shift the air/fuel ratio from the lean range to the rich range through a rich purge. In this way, the deoxidizing agent, such as HC, CO, is supplied to the NOx catalytic converter 21, and thereby the NOx, which is absorbed by the NOx catalytic converter 21, is deoxidized and removed at the NOx catalytic converter 21 by the deoxidizing agent. At this time, the absorbed NOx is converted to nitrogen ($N_2$), carbon dioxide ($CO_2$) and water ($H_2O$) and is thereby removed from the NOx catalytic converter 21. Through the removal of NOx, the NOx purifying performance of the NOx catalytic converter 21 is recovered.

(2) The fuel adding valve 25 may be used to add fuel into the exhaust gas. In this way, HC, which serves as the deoxidizing agent, is supplied to the NOx catalytic converter 21, and thereby the absorbed NOx, which is absorbed by the catalyst of the NOx catalytic converter 21, is deoxidized and removed by the deoxidizing agent. At this time, similar to the rich purge control operation, the absorbed NOx is converted to nitrogen ($N_2$), carbon dioxide ($CO_2$) and water ($H_2O$) and is thereby removed from the NOx catalytic converter 21. Through the removal of NOx, the NOx purifying performance of the NOx catalytic converter 21 is recovered.

One of the rich purge control operation described in the above section (1) and the fuel addition into the exhaust gas described in the above section (2) is selected and is performed according to an operational range of the engine 10. In this instance, the NOx deoxidization control operation through the rich purge is performed normally. However, when the rich purge is performed at the time of driving the engine 10 under the high load or the high rotational speed, such as at the time of driving the vehicle at the high traveling speed, the amount of the exhaust smoke outputted from the engine 10 is disadvantageously increased. Thus, at the time of driving the engine 10 under the high load or the high rotational speed, the NOx deoxidization control operation is performed through the addition of the fuel into the exhaust gas.

Furthermore, at the time of performing the NOx deoxidization control operation, the ECU 30 performs a purifying performance determining operation for determining whether the purifying performance of the NOx catalytic converter 21 is decreased due to sulfur poisoning and/or the catalyst deterioration. The purifying performance determining operation is performed based on the measurement signals of the A/F sensors 23, 24, which are provided on the upstream side and the downstream side, respectively, of the NOx catalytic converter 21. Based on the determination result of the purifying performance determining operation, it is determined whether a sulfur poisoning regeneration control operation (a desulfuring operation) is required, or a degree of catalyst deterioration is determined. The NOx absorbing performance of the NOx catalytic converter 21 is decreased when sulfur oxide (SOx) adheres to the NOx catalytic converter 21 (more specifically to the catalyst of the NOx catalytic converter 21).

The purifying performance determining operation of the NOx catalytic converter 21 may be performed based on the fact that the amount of the supplied deoxidizing agent and the actual amount of the absorbed NOx correlate to each other. Specifically, the amount of the supplied deoxidizing agent is predicted based on the measurement signals from the A/F sensors 23, 24, and the decrease in the purifying performance of the NOx catalytic converter 21 (i.e., the degree of sulfur poisoning of the NOx catalytic converter 21 or the degree of catalyst deterioration) is determined. Specifically, at the time of performing the NOx deoxidization control operation, the ECU 30 senses the start timing, at which the supplying of the deoxidizing agent (rich agent) to the NOx catalytic converter 21 starts, based on the measurement signal of the upstream side A/F sensor 23, and the ECU 30 also senses the end timing, at which the deoxidization and removal of the absorbed NOx at the NOx catalytic converter 21 is completed, based on the measurement signal of the downstream side A/F sensor 24. Then, the ECU 30 determines the decrease in the purifying performance of the NOx catalytic converter 21 based on a required time period between the start timing and the end timing.

In the sulfur poisoning regeneration control operation, the ECU 30 performs the rich purge in a manner similar to that of the NOx deoxidization control operation. However, at this time, unlike the NOx deoxidization control operation, the rich purge is maintained for a relatively long period of time, and the state of the hot rich atmosphere, which has the high temperature and the rich air/fuel ratio, is maintained. In this way, SOx, which is absorbed in the NOx catalytic converter 21, is released, and the purifying performance of the NOx catalytic converter 21 is recovered. Alternatively, the fuel addition from the fuel adding valve 25 may be continuously performed to release the SOx from the NOx catalytic converter 21.

As described above, at the time of performing the purifying performance determining operation of the NOx catalytic converter 21 simultaneously with the NOx deoxidization control operation, when the fuel is added to the exhaust gas to control the NOx deoxidization, the purifying performance determining accuracy may possibly be deteriorated. Specifically, the rich purge control operation and the fuel addition into the exhaust gas cause the supply of the deoxidizing agent to the NOx catalytic converter 21. However, at the time of the rich purge control operation, the absorbed NOx is released from the NOx catalytic converter 21 due to the deoxidization reaction of CO, which is mainly contained in the exhaust gas. In contrast, at the time of the fuel addition into the exhaust gas, the absorbed NOx is released from the NOx catalytic converter 21 due to the deoxidization reaction of HC, which is directly supplied as the deoxidizing agent. In such a case, at the time of performing the fuel addition into the exhaust gas, the supplied HC becomes excessive in comparison to the one measured at the time of performing the rich purge control operation. Because of this, the relationship between the amount of the supplied deoxidizing agent and the actual amount of the absorbed NOx collapses. Therefore, the purifying performance determination accuracy is decreased.

Furthermore, the deoxidization reaction by CO shows a faster reaction speed in comparison to the deoxidization reaction by HC. Thus, even when the large amount of HC is supplied to deoxidize and remove the absorbed NOx at the NOx catalytic converter 21, the majority of the supplied HC flows through the NOx catalytic converter 21 without participating in the deoxidization reaction of the absorbed NOx. Thus, the sensing of the rich state occurs due to the excess HC, which has passed through the NOx catalytic converter 21, on the downstream side of the NOx catalytic converter 21 even before the completion of the NOx deoxidization. Thus, the amount of the supplied deoxidizing agent, which is actually required to deoxidize the absorbed NOx, cannot be accurately obtained.

Thus, according to the present embodiment, at the time of determining the purifying performance of the NOx catalytic converter 21, when the fuel addition into the exhaust gas is performed in the NOx deoxidization control operation, the purifying performance determining operation is not performed. In this way, the erroneous determination can be advantageously limited.

Figure 2:
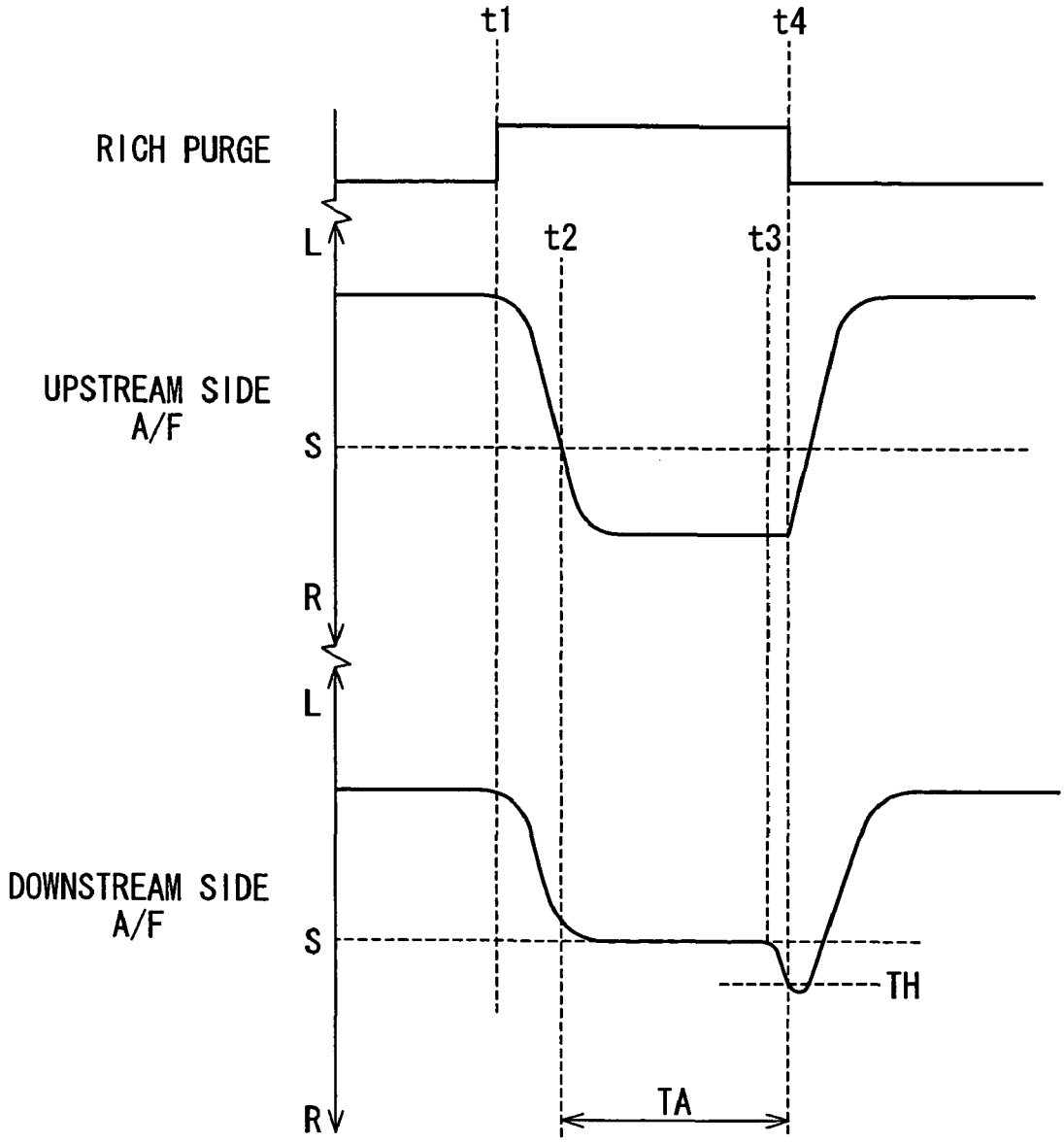
FIG. 2 is a time chart schematically showing a rich purge control operation and a purifying performance determining operation for determining a purifying performance of an NOx catalytic converter according to the embodiment.

Now, the rich purge control operation, which is performed as the NOx deoxidization control operation, and the purifying performance determining operation of the NOx catalytic converter 21, which is performed simultaneously with the rich purge control operation, will be schematically described with reference to a time chart shown in FIG. 2. In FIG. 2, a top graph part indicates an on and off of a rich purge with reference to time. Also, an intermediate graph part indicates the measurement result of the upstream side A/F sensor 23, which is provided on the upstream side of the NOx catalytic converter 21, with reference to time, and a bottom graph part indicates the measurement result of the downstream side A/F sensor 24, which is provided on the downstream side of the NOx catalytic converter 21, with reference to time. Furthermore, in the middle and bottom graph parts of FIG. 2, "L" denotes "lean", and "R" denotes "rich", and "S" denotes a stoichiometric air/fuel ratio.

In FIG. 2, at the timing t1, a predetermined execution condition for initiating the rich purge is satisfied, so that the rich purge is started, and the fuel injection quantity of the injector 11 is increased. Thereby, the upstream side air/fuel ratio, which is measured with the A/F sensor 23, begins to shift from the lean range into the rich range. At the timing t2, the upstream side air/fuel ratio is shifted into the rich range. Here, a time difference between the timing t1, at which the rich purge is started, and the timing t2, at which the upstream side air/fuel ratio is changed from the lean range into the rich range, is caused by, for example, a time lag in the conduction of the exhaust gas flow in the exhaust pipe and/or a response time lag of the A/F sensor 23.

After the timing t2, the deoxidizing agent in the exhaust gas reacts with the absorbed NOx in the NOx catalytic converter 21, so that the deoxidization and removal of the NOx begins in the NOx catalytic converter 21. In the NOx catalytic converter 21, the supplied deoxidizing agent is substantially entirely consumed, so that the downstream side air/fuel ration is held generally in the stoichiometric air/fuel ratio (theoretical air/fuel ratio).

Then, when the deoxidization of the absorbed NOx in the NOx catalytic converter 21 is completed, the supplied deoxidizing agent does not react in the NOx catalytic converter 21 any longer and is thereby outputted from the NOx catalytic converter 21 on the downstream side thereof. Therefore, at the timing t3, at which the NOx deoxidization is completed, the downstream side air/fuel ratio, which is measured with the downstream side A/F sensor 24, begins to shift into the rich range. Then, at the timing t4, the downstream side air/fuel ratio reaches a rich side threshold value TH, so that it is determined that the NOx deoxidization is completed. The timing t4 is the end timing of the rich purge. Therefore, the fuel injection quantity control operation is returned to the normal control operation after the timing t4.

At the time of the rich purge, the amount of the supplied deoxidizing agent to the NOx catalytic converter 21 can be estimated based on a time difference (a required deoxidization time period TA) between the timing of shifting the upstream side air/fuel ratio into the rich range and the timing of shifting the downstream side air/fuel ratio into the rich range. Specifically, the required deoxidization time period TA corresponds to a parameter, which correlates to the amount of the supplied NOx deoxidizing agent. An NOx absorbing performance of the NOx catalytic converter 21 can be estimated based on the required deoxidization time period TA. At this time, when the sulfur poisoning or the catalyst deterioration progresses in the NOx catalytic converter 21, the amount of the absorbed NOx at the NOx catalytic converter 21 decreases even in the case where the constant amount of the supplied NOx, which is supplied to the NOx catalytic converter 21 through the exhaust pipe 18, is maintained. Thus, the required deoxidization time period TA is shortened. Therefore, it is possible to determine the decrease in the purifying performance of the NOx catalytic converter 21, which is caused by the sulfur poisoning or the catalyst deterioration.

Figure 3:
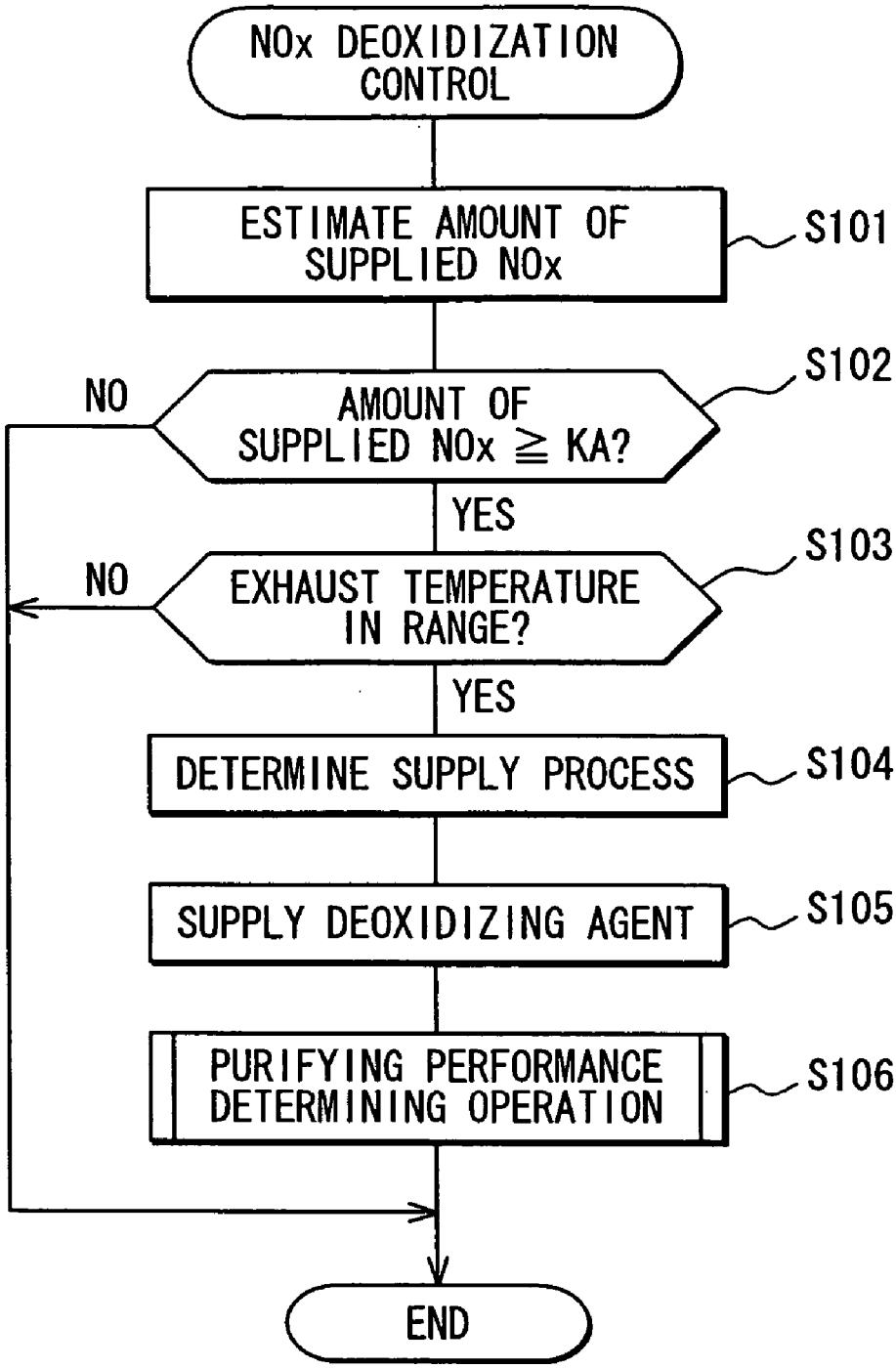
FIG. 3 is a flowchart showing a procedure of an NOx deoxidization control operation according to the embodiment.

Next, the NOx deoxidization control operation of the NOx catalytic converter 21 and the purifying performance determining operation, which are executed by the ECU 30, will be described. FIG. 3 shows a flowchart that indicates the procedure of the NOx deoxidization control operation, which is repeated at predetermined time intervals.

With reference to FIG. 3, at step S101, the amount of the supplied NOx, which is supplied to the NOx catalytic converter 21 through the exhaust pipe 18, is estimated. At this time, the amount of the supplied NOx can be estimated based on the engine operational state (operational mode) at each time. For example, the combustion temperature may be computed based on the engine rotational speed and/or the load (e.g., the accelerator operational amount), and the generated NOx concentration may be computed based on the combustion temperature. Then, the amount of NOx may be obtained based on the generated NOx concentration and the exhaust gas flow quantity. Thereafter, the amount of the supplied NOx may be estimated by summing (cumulating) each obtained amount of NOx. Alternatively, the NOx concentration in the exhaust gas may be sensed with an NOx sensor, which is provided in the exhaust pipe. Then, the amount of the supplied NOx may be computed based on the sensed NOx concentration.

Then, at step S102, it is determined whether the estimated amount of the supplied NOx, which is estimated at step S101, is equal to or greater than a predetermined threshold value KA. When it is determined that the estimated amount of the supplied NOx is less than the predetermined threshold value KA at step S102 (i.e., NO at step S102), the ECU 30 determines that the supply of the deoxidizing agent to the NOx catalytic converter 21 is not required at this time. Thus, the ECU 30 terminates the current operation.

In contrast, when it is determined that the estimated amount of the supplied NOx is equal to or larger than the predetermined threshold value KA at step S102 (i.e., YES at step S102), the ECU 30 proceeds to step S103. At step S103, the exhaust gas temperature is measured based on the measurement signal of the exhaust temperature sensor 27, and it is determined whether the measured exhaust gas temperature is within a predetermined temperature range (min to max). In the present instance, the above temperature range is the temperature condition, which needs to be satisfied to properly perform the NOx deoxidization in the NOx catalytic converter 21. The above lower limit value "min" is the minimum required temperature, which is required to perform the deoxidization reaction in the NOx catalytic converter 21. For example, the lower limit value "min" may be set to 300 degrees Celsius. The above upper limit value "max" is the temperature, at which the absorbed NOx is released from the NOx catalytic converter 21 regardless of the supply of the deoxidizing agent. For example, the upper limit value "max" may be set to 450 degrees Celsius.

When it is determined that the exhaust gas temperature is not within the predetermined temperature range at step S103 (i.e., NO at step S103), the current operation is terminated. In contrast, when it is determined that the exhaust gas temperature is within the predetermined temperature range at step S103 (i.e., YES at step S103), the ECU 30 proceeds to step S104.

Figure 5:
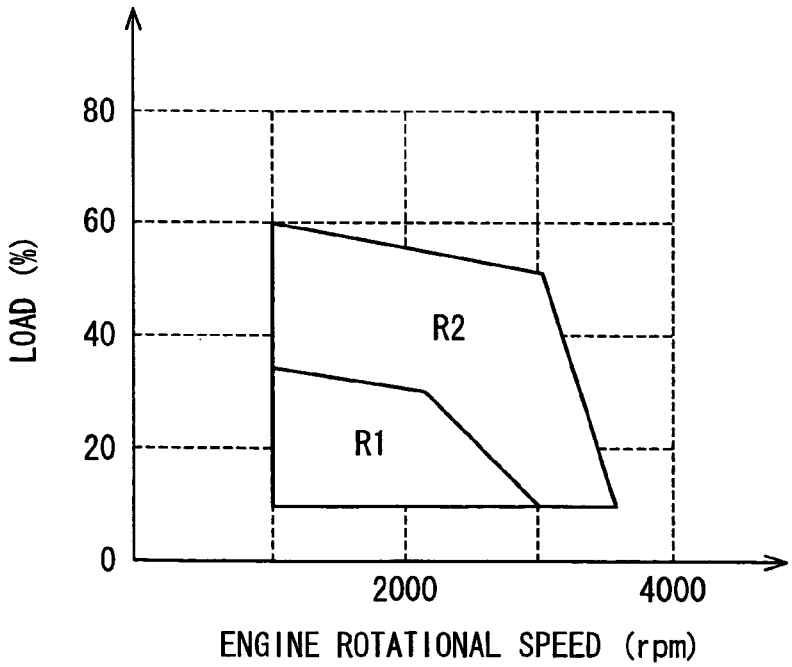
FIG. 5 is a diagram showing a relationship between an engine rotational speed and an engine load used to select a deoxidizing agent supply process in the NOx deoxidization control operation.

At step S104, the deoxidizing agent supply process used at the time of performing the NOx deoxidization in the NOx catalytic converter 21 is determined. Here, one of the deoxidizing agent supply process using the rich purge and the deoxidizing agent supply process using the fuel addition into the exhaust gas is selected based on the engine operational range. For instance, the deoxidizing agent supply process may be determined based on the relationship shown in FIG. 5. In FIG. 5, the engine rotational speed and the engine load (e.g., the accelerator operational amount) are used as parameters. Furthermore, an execution range (R1) for executing the rich purge and an execution range (R2) for executing the fuel addition into the exhaust gas are defined in FIG. 5. The execution range R2 for executing the fuel addition into the exhaust gas is set at the higher rotational speed and higher engine load side in comparison to the execution range R1 for executing the rich purge.

Furthermore, at step S105, the deoxidizing agent is supplied to the NOx catalytic converter 21 through the deoxidizing agent supply process, which is determined at step S104. When the deoxidizing agent is supplied to the NOx catalytic converter 21 at step S105, the absorbed NOx is deoxidized and is removed at the NOx catalytic converter 21. At this time, when the deoxidizing agent is supplied to the NOx catalytic converter 21 through the deoxidizing agent supply process using the rich purge, the start timing of the NOx deoxidization and removal is sensed based on the upstream side air/fuel ratio measured with the A/F sensor 23, and also the end timing of the NOx deoxidization and removal is sensed based on the downstream side air/fuel ratio measured with the A/F sensor 24, as discussed with reference to FIG. 2. Then, the required deoxidization time period TA is computed based on the start timing of the deoxidization and the end timing of the deoxidization. When the NOx deoxidization is ended, the rich purge is terminated. Similar to the case of the deoxidizing agent supply process using the rich purge, in the case of the deoxidizing agent supply process using the fuel addition into the exhaust gas, the end of the NOx deoxidization and removal is sensed based on the downstream side air/fuel ratio, and the fuel addition into the exhaust gas is terminated at the end of the NOx deoxidization.

Thereafter, at step S106, the purifying performance determining operation of the NOx catalytic converter 21 is performed based on the required deoxidization time period TA. The procedure of the purifying performance determining operation will be described based on a flowchart shown in FIG. 4.

Figure 4:
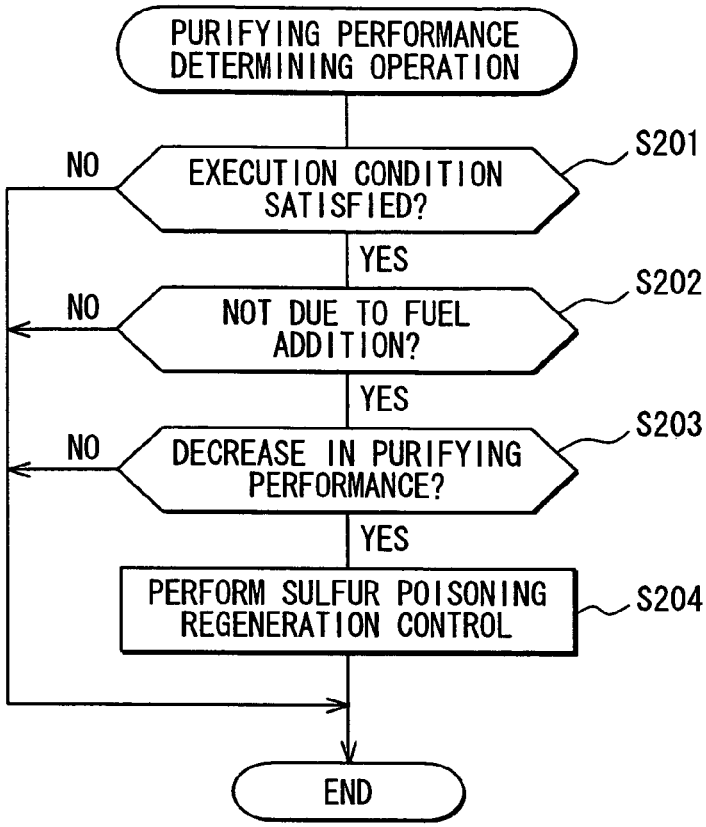
FIG. 4 is a flowchart showing a procedure of the purifying performance determining operation for determining the purifying performance of the NOx catalytic converter.

With reference to FIG. 4, at step S201, it is determined whether the predetermined execution condition for executing the purifying performance determining operation is satisfied. This execution condition is a condition, in which the decrease in the purifying performance of the NOx catalytic converter 21 is supposed to take place due to the sulfur poisoning and/or the catalyst deterioration. For example, a travel distance of the vehicle may be measured, and the execution condition may be satisfied every time the travel distance of the vehicle reaches a predetermined distance (e.g., 10,000 km). Alternatively, a total fuel injection quantity (a cumulative value of every fuel injection quantity) of the injector 11 may be computed, and the execution condition may be satisfied every time the total fuel injection quantity reaches a predetermined quantity. Then, when the execution condition is satisfied, the ECU 30 proceeds to step S202.

At step S202, it is determined whether the supply of the deoxidizing agent is due to the fuel addition into the exhaust gas in the current run of NOx deoxidization control operation. When it is determined that the supply of the deoxidizing agent is not due to the fuel addition into the exhaust gas but is due to the rich purge at step S202 (i.e., YES at step S202), the ECU 30 enables the current purifying performance determining operation and thereby proceeds to step S203. In contrast, when it is determined that the supply of the deoxidizing agent is due to the fuel addition into the exhaust gas at step S202 (i.e., NO at step S202), the ECU 30 prohibits the execution of the current purifying performance determining operation and terminates the current operation.

At step S203, it is determined whether the purifying performance of the NOx catalytic converter 21 is decreased based on the required deoxidization time period TA, which is computed at the time of executing the NOx deoxidization control operation. For example, the required deoxidization time period TA may be compared with a preset determination reference time. When the required deoxidization time period TA is equal to or longer than the preset determination reference time, it may be determined that the purifying performance of the NOx catalytic converter 21 is not decreased. Furthermore, when the required deoxidization time period TA is less than the preset determination reference time, it may be determined that the purifying performance of the NOx catalytic converter 21 is decreased. When it is determined that the purifying performance is decreased at step S203 (i.e., YES at step S203), the ECU 30 proceeds to step S204. At step S204, the sulfur poisoning regeneration control operation is performed to recover the purifying performance of the NOx catalytic converter 21.

Here, a second determination reference time, which is shorter than the above determination reference time, may be set. When it is determined that the required deoxidization time period TA is less than the second determination reference time, a fail determination may be made. In the case where YES is returned at step S203, when the sulfur poisoning regeneration control operation has been repeated a predetermined number of times, the fail determination may be made immediately without performing the next sulfur poisoning regeneration control operation.

The present embodiment provides the following advantages.

At the time of executing the NOx deoxidization control operation, it is determined whether the supplied HC is in an excessive state where the supplied HC is excessive for the NOx catalytic converter 21. When it is determined that the supplied HC is in the excessive state, the purifying performance determining operation of the NOx catalytic converter 21 is prohibited. Particularly, in the present embodiment, when the fuel addition into the exhaust gas is performed, it is determined that the supplied HC is in the excessive state. In this way, the erroneous determination of the purifying performance of the NOx catalytic converter 21 can be advantageously avoided. Therefore, the purifying performance determination accuracy of the NOx catalytic converter is improved, and the exhaust emission is appropriately controlled.

At the time of performing the NOx deoxidization control operation, the switching of the operation between the rich purge through the injector 11 and the fuel addition into the exhaust gas through the fuel adding valve 25 is performed based on the engine operational range. Thus, at the time of the NOx deoxidization control operation, the purifying performance determination of the NOx catalytic converter 21 can be relatively accurately made while the deterioration of the exhaust emission (e.g., the increase in the smoke exhaust amount caused by the rich purge) is limited.

In the state where the predetermined amount of NOx is supplied to the NOx catalytic converter 21, the start timing of the NOx deoxidization and the end timing of the NOx deoxidization are sensed based on the measurement of the upstream side A/F sensor 23 and the measurement of the downstream side A/F sensor 24, respectively. Then, the required time period (the required deoxidization time period TA) between the start timing and the end timing is computed. In this case, the required deoxidization time period TA correlates with the amount of the supplied NOx deoxidizing agent. Thus, the decrease in the purifying performance of the NOx catalytic converter 21 can be appropriately determined based on the required deoxidization time period TA.

In the case where the purifying performance determination of the NOx catalytic converter 21 is performed based on the measurements of the A/F sensors 23, 24, when the supplied HC is in the excessive state, the sensor measurement result may also become erroneous. However, as discussed above, the purifying performance determination is prohibited when the supplied HC is in the excessive state, so that the purifying performance determination accuracy can be improved.

The execution condition for executing the NOx deoxidization control operation is satisfied when the exhaust gas temperature is within the predetermined temperature range (min to max). Thus, at the time of supplying the NOx deoxidizing agent, the appropriate NOx deoxidization and removal can be performed by the supplied deoxidizing agent. Furthermore, the above condition setting allows the improvement in the purifying performance determination accuracy of the NOx catalytic converter 21.

The present invention is not limited to the above embodiment. For example, the above embodiment may be modified in the following manner.

Figure 6:
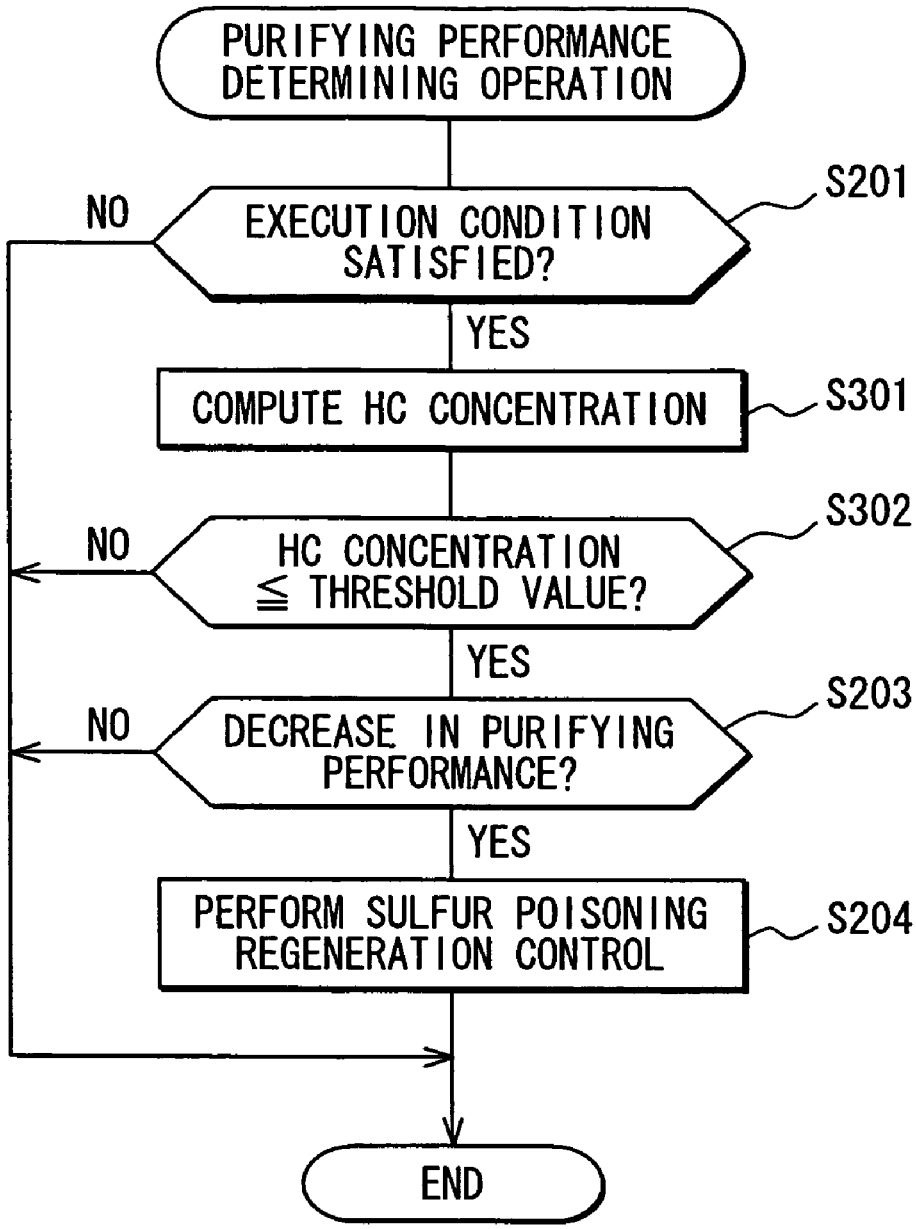
FIG. 6 is a flowchart showing a modification of the procedure of the purifying performance determining operation for determining the purifying performance of the NOx catalytic converter.
Figure 7:
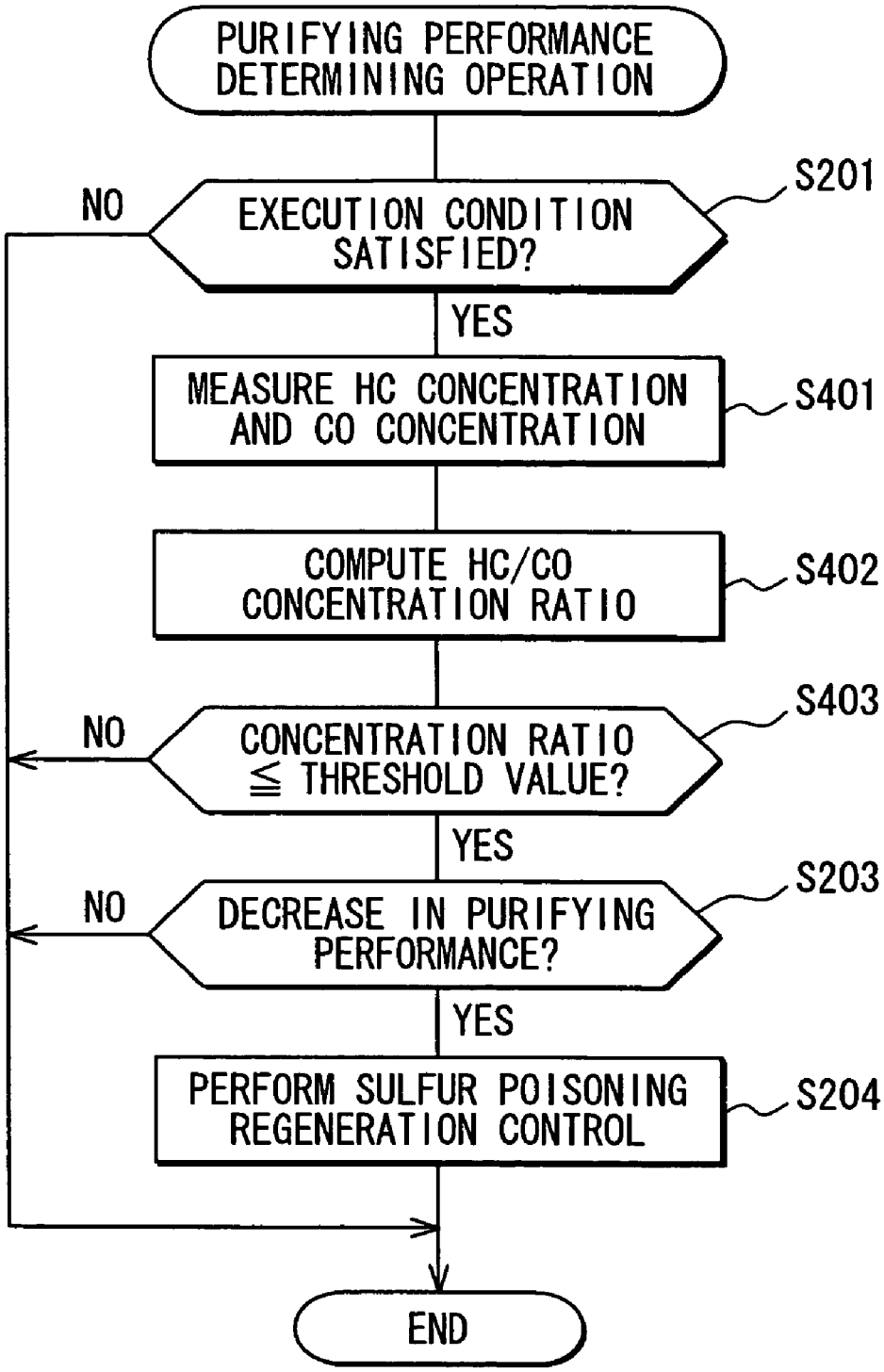
FIG. 7 is a flowchart showing another modification of the procedure of the purifying performance determining operation for determining the purifying performance of the NOx catalytic converter.

In the above embodiment, at the time of performing the NOx deoxidization control operation, when the fuel addition into the exhaust gas is performed, it is determined that the supplied HC is in the excessive state, and thereby the purifying performance determination of the NOx catalytic converter 21 is prohibited. This may be modified as follows. Here, the HC concentration (or the HC amount) in the exhaust gas may be measured. When the measured HC concentration (or the measured HC amount) exceeds a corresponding threshold value, it may be determined that the supplied HC is in the excessive state, and thereby the determination of the purifying performance of the NOx catalytic converter 21 may be prohibited. Alternatively, a component ratio of HC in the exhaust gas may be measured. When the measured component ratio of HC in the exhaust gas exceeds a corresponding threshold value, it may be determined that the supplied HC is in the excessive state, and thereby the determination of the purifying performance of the NOx catalytic converter 21 may be prohibited. FIGS. 6 and 7 show flowcharts of the specific procedures of these cases. The procedure of FIG. 6 or 7 is performed in place of the procedure of FIG. 4, so that similar steps of FIG. 6 or 7, which are similar to those of FIG. 4, will be indicated by the same step numbers and will not be described further in the following description.

In each of the following procedures, measurement of the HC concentration and/or the CO concentration in the exhaust gas is required and is performed in the following manner. That is, in the exhaust pipe 18 of the engine 10, an HC concentration sensor is provided on the upstream side of the NOx catalytic converter 21 in the exhaust pipe 18 of the engine 10. An HC concentration measurement value is computed based on the measurement result of the HC concentration sensor. Furthermore, a CO concentration sensor is provided on the upstream side of the NOx catalytic converter 21 in the exhaust pipe 18 of the engine 10. A CO concentration measurement value is computed based on the measurement result of the CO concentration sensor.

In FIG. 6, when the execution condition for executing the purifying performance determining operation is satisfied (i.e., YES at step S201), the ECU 30 proceeds to step S301. At step S301, the HC concentration in the exhaust gas is measured. Then, the ECU 30 proceeds to step S302. At step S302, it is determined whether the HC concentration measurement value is equal to or less than a predetermined threshold value. When it is determined that the HC concentration measurement value is equal to or less than the threshold value at step S302 (i.e., YES at step S302), the ECU 30 permits the execution of the current purifying performance determining operation and thereby proceeds to step S203. In contrast, when it is determined that the HC concentration measurement value is larger than the threshold value at step S302 (i.e., NO at step S302), the ECU 30 determines that the supplied HC is in the excessive state and thereby prohibits the execution of the current purifying performance determination operation. Then, the ECU 30 terminates the current operation.

With reference to FIG. 7, when it is determined that the execution condition for executing the purifying performance determining operation is satisfied (i.e., YES at step S201), the ECU 30 proceeds to step S401. At step S401, the HC concentration and the CO concentration in the exhaust gas are measured. Then, at step S402, the ECU 30 computes a concentration ratio between the HC concentration and the CO concentration (the concentration ratio=HC concentration/CO concentration, which corresponds to HC component ratio). Then, at step S403, it is determined whether the computed concentration ratio is equal to or less than a predetermined threshold value. When it is determined that the concentration ratio is equal to or less than the threshold value at step S403 (i.e., YES at step S403), the ECU 30 permits the execution of the current purifying performance determining operation and thereby proceeds to step S203. In contrast, when it is determined that the concentration ratio is larger than the threshold value at step S403 (i.e., NO at step S403), the ECU 30 determines that the supplied HC is in the excessive state and thereby prohibits the execution of the current purifying performance determination operation. Then, the ECU 30 terminates the current operation.

In the case where the operation shown in FIG. 6 or 7 is used, when it is determined that the supplied HC is in the excessive state, the purifying performance determination operation for determining the purifying performance of the NOx catalytic converter 21 is prohibited. Thus, it is possible to avoid the erroneous determination of the purifying performance of the NOx catalytic converter 21.

In the operation of FIG. 6 or 7, the HC concentration or CO concentration in the exhaust gas may be obtained through a computation, which uses a map or a mathematical equation. Specifically, the amount of the fuel addition into the exhaust gas through the fuel adding valve 25 may be used as a parameter to compute the HC concentration or the CO concentration in the exhaust gas in view of, for example, preset map data. In this case, in addition to the amount of the fuel addition into the exhaust gas through the fuel adding valve 25, the exhaust gas temperature and/or the exhaust gas flow quantity may be used as the parameters in the computation of the HC concentration and/or the CO concentration to increase the accuracy of the computation.

In the above embodiment, one of the rich purge and the fuel addition into the exhaust gas is selected to perform the NOx deoxidization control operation. Alternatively, both of the rich purge and the fuel addition into the exhaust gas may be simultaneously performed. For example, at the time of performing the rich purge, the fuel addition into the exhaust gas through the fuel adding valve 25 may be performed. In such a case, when the fuel addition into the exhaust gas is performed simultaneously at the time of performing the rich purge, the purifying performance determining operation for determining the purifying performance of the NOx catalytic converter 21 is prohibited.

Furthermore, in the above embodiment, the fuel adding valve 25 is used as a fuel adding means for adding the unburnt fuel (HC) on the upstream side of the NOx catalytic converter 21. Alternative to the fuel adding valve 25, the following measures may be used as the fuel adding means. Specifically, a post injection, which is one of fuel injections (multi-stage injections of fuel) in a multi-stage fuel injection operation carried out through the injector 11, is performed, and the unburnt fuel, which is supplied due to the post injection, may be used to deoxidize and remove the absorbed NOx at the NOx catalytic converter 21. The post injection is also referred to as an after injection and is performed after a main injection. The injected fuel, which is injected in the post injection, is not combusted in the cylinder and is exhausted as the unburnt fuel into the exhaust pipe 18. In this case, the post injection is performed as the NOx deoxidization control operation, so that the absorbed NOx, which is absorbed in the NOx catalytic converter 21, is deoxidized and removed by the deoxidizing agent.

When the post injection is performed as the NOx deoxidization control operation, the unburnt fuel, which is supplied to the NOx catalytic converter 21, becomes excessive. Thus, in such a case, similar to the fuel addition into the exhaust gas through the fuel adding valve 25, the purifying performance determining operation for determining the purifying performance of the NOx catalytic converter 21 is prohibited. In this way, the erroneous determination of the purifying performance of the NOx catalytic converter 21 can be advantageously avoided.

In the above embodiment, the required deoxidization time period TA is computed based on the start timing and the end timing of the NOx deoxidization, which are sensed based on the measurement of the upstream side A/F sensor 23 and the measurement of the downstream side A/F sensor 24. Then, the purifying performance of the NOx catalytic converter 21 is determined based on the required deoxidization time period TA. This may be modified as follows. That is, it is desirable to consider a rich degree of the air/fuel ratio in addition to the required deoxidization time period TA to more accurately obtain the amount of the supplied deoxidizing agent at the time of performing the NOx deoxidization control operation. Therefore, the amount of the supplied NOx deoxidizing agent may be computed based on the required deoxidization time period TA and the upstream side air/fuel ratio (the measurement of the upstream side A/F sensor 23) at the time of the NOx deoxidization. Then, the purifying performance of the NOx catalytic converter 21 may be determined based on the computed amount of the NOx deoxidizing agent.

Alternatively, the purifying performance of the NOx catalytic converter 21 may be determined in a more simple way without using the measurement of the upstream side A/F sensor 23. That is, the start timing of the NOx deoxidization control operation may be used as a reference time point, and the ECU 30 may compute the required deoxidization time period as a time period from the reference time point to a time point, at which the rich agent(s) is sensed by the downstream side A/F sensor 24. Then, the ECU 30 may determine the purifying performance of the NOx catalytic converter 21 based on this required deoxidization time period. In such a case, the A/F sensor (oxygen concentration sensor) should be provided at least on the downstream side of the NOx catalytic converter 21.

Additional advantages and modifications will readily occur to those skilled in the art. The invention in its broader terms is therefore not limited to the specific details, representative apparatus, and illustrative examples shown and described.

What is claimed is:

1. An exhaust gas purifying system for an internal combustion engine, comprising:

an NOx catalytic converter that includes an NOx storage and reduction catalyst and is provided in an exhaust system of the internal combustion engine;

an NOx deoxidization control means for supplying and controlling an NOx deoxidizing agent to the NOx catalytic converter at a time of deoxidizing and removing absorbed NOx, which is absorbed by the NOx storage and reduction catalyst;

a purifying performance determining means for determining a purifying performance of the NOx catalytic converter based on one of:

an amount of the supplied NOx deoxidizing agent, which is required to deoxidize and remove the absorbed NOx at a time of operating the NOx deoxidization control means; and a parameter that correlates with the amount of the supplied NOx deoxidizing agent;

an unburnt fuel state determining means for determining whether supplied unburnt fuel, which is supplied to the NOx catalytic converter, is in an excessive state at the time of operating the NOx deoxidization control means; and a prohibiting means for prohibiting the purifying performance determining means from determining the purifying performance of the NOx catalytic converter when the unburnt fuel state determining means determines that the supplied unburnt fuel is in the excessive state;

wherein the NOx deoxidization control means includes:

a rich purge means for temporarily shifting an air/fuel ratio of the internal combustion engine into a rich range; and a fuel adding means for adding and supplying the unburnt fuel to the NOx catalytic converter;

the NOx deoxidization control means selects and uses one of the rich purge means and the fuel adding means to supply the NOx deoxidizing agent to the NOx catalytic converter; and the unburnt fuel state determining means determines that the unburnt fuel is in the excessive state whenever the fuel adding means is operated to add and supply the unburnt fuel to the NOx catalytic converter.

2. The exhaust gas purifying system according to claim 1, wherein the NOx deoxidization control means selects and uses the one of the rich purge means and the fuel adding means based on an operational range of the internal combustion engine.

3. The exhaust gas purifying system according to claim 1, wherein:

the fuel adding means includes a fuel adding valve, which is provided on an upstream side of the NOx catalytic converter in the exhaust system; and the fuel adding means operates the fuel adding valve to add and supply the unburnt fuel to the NOx catalytic converter.

4. The exhaust gas purifying system according to claim 1, wherein:

the fuel adding means includes a fuel injection valve, which performs multi-stage injections of fuel into a corresponding cylinder of the internal combustion engine; and the fuel adding means controls the fuel injection valve to perform a post injection of the fuel injection valve after a main injection of the fuel injection valve in the multi-stage fuel injections to add and supply the unburnt fuel to the NOx catalytic converter.

5. The exhaust gas purifying system according to claim 1, wherein:

the unburnt fuel state determining means senses or computes one of an amount of the supplied unburnt fuel to the NOx catalytic converter and an unburnt fuel concentration in gas in the exhaust system; and the unburnt fuel state determining means determines that the supplied unburnt fuel, which is supplied to the NOx catalytic converter, is in the excessive state when the one of the amount of the supplied unburnt fuel and the unburnt fuel concentration in the gas exceeds a predetermined corresponding threshold value.

6. The exhaust gas purifying system according to claim 1, wherein:

the unburnt fuel state determining means computes a component ratio of the unburnt fuel in gas, which is supplied to the NOx catalytic converter; and the unburnt fuel state determining means determines that the supplied unburnt fuel, which is supplied to the NOx catalytic converter, is in the excessive state when the component ratio of the unburnt fuel in the gas exceeds a predetermined corresponding threshold value.

7. The exhaust gas purifying system according to claim 6, wherein the unburnt fuel state determining means computes the component ratio of the unburnt fuel in the gas based on one of an amount of the supplied unburnt fuel to the NOx catalytic converter and an unburnt fuel concentration in the gas in the exhaust system.

8. The exhaust gas purifying system according to claim 5, wherein:

the unburnt fuel state determining means computes the one of the amount of the unburnt fuel and the unburnt fuel concentration based on the amount of the added and supplied unburnt fuel, which is added and supplied by the fuel adding means.

9. The exhaust gas purifying system according to claim 1, wherein:

the purifying performance determining means includes at least one oxygen concentration sensor that measures an oxygen concentration in the exhaust gas;

at least one of the at least one oxygen concentration sensor is provided on a downstream side of the NOx catalytic converter;

the purifying performance determining means determines that the deoxidizing of the absorbed NOx at the NOx catalytic converter is completed when the purifying performance determining means senses that the NOx deoxidizing agent begins to flow out of the NOx catalytic converter after initiation of the supplying and controlling of the NOx deoxidizing agent to the NOx catalytic converter based on a measurement of the at least one oxygen concentration sensor; and the purifying performance determining means determines the purifying performance of the NOx catalytic converter based on a required time period that is required to complete the deoxidizing of the absorbed NOx since the initiation of the supplying and controlling of the NOx deoxidizing agent.

10. A method of purifying exhaust gas of an internal combustion engine, the method comprising:

providing an NOx catalytic converter that includes an NOx storage and reduction catalyst in an exhaust system of the internal combustion engine;

providing NOx deoxidization control by supplying and controlling an NOx deoxidizing agent to the NOx catalytic converter at a time of deoxidizing and removing absorbed NOx, which is absorbed by the NOx storage and reduction catalyst;

determining a purifying performance of the NOx catalytic converter based on one of:

an amount of the supplied NOx deoxidizing agent, which is required to deoxidize and remove the absorbed NOx at a time of operating the NOx deoxidization control; and a parameter that correlates with the amount of the supplied NOx deoxidizing agent;

determining whether supplied unburnt fuel, which is supplied to the NOx catalytic converter, is in an excessive state at the time of operating the NOx deoxidization control; and prohibiting the determining of the purifying performance of the NOx catalytic converter when the determining is made that the supplied unburnt fuel is in the excessive state;

wherein the NOx deoxidization control includes:

a rich purge including temporarily shifting an air/fuel ratio of the internal combustion engine into a rich range; and a fuel adding including adding and supplying the unburnt fuel to the NOx catalytic converter;

the NOx deoxidization control includes selecting and using one of the rich purge and the fuel adding to supply the NOx deoxidizing agent to the NOx catalytic converter; and the determining whether the unburnt fuel is in the excessive state is performed whenever the fuel adding is operated to add and supply the unburnt fuel to the NOx catalytic converter.

11. The method according to claim 10, wherein the NOx deoxidization control includes selecting and using the one of the rich purge and the fuel adding based on an operational range of the internal combustion engine.

12. The method according to claim 10, wherein:

the fuel adding includes operating a fuel adding valve, which is provided on an upstream side of the NOx catalytic converter in the exhaust system, to add and supply the unburnt fuel to the NOx catalytic converter.

13. The method according to claim 10, wherein:

the fuel adding includes performing, by a fuel injection valve, multi-stage injections of fuel into a corresponding cylinder of the internal combustion engine; and the fuel adding includes controlling the fuel injection valve to perform a post injection of the fuel injection valve after a main injection of the fuel injection valve in the multi-stage fuel injections to add and supply the unburnt fuel to the NOx catalytic converter.

14. The method according to claim 10, wherein:

the determining whether supplied unburnt fuel is in an excessive state includes sensing or computing one of an amount of the supplied unburnt fuel to the NOx catalytic converter and an unburnt fuel concentration in gas in the exhaust system; and the determining whether supplied unburnt fuel is in an excessive state includes determining that the supplied unburnt fuel, which is supplied to the NOx catalytic converter, is in the excessive state when the one of the amount of the supplied unburnt fuel and the unburnt fuel concentration in the gas exceeds a predetermined corresponding threshold value.

15. The method according to claim 10, wherein:

the determining whether supplied unburnt fuel is in an excessive state includes computing a component ratio of the unburnt fuel in gas, which is supplied to the NOx catalytic converter; and the determining whether supplied unburnt fuel is in an excessive state includes determining that the supplied unburnt fuel, which is supplied to the NOx catalytic converter, is in the excessive state when the component ratio of the unburnt fuel in the gas exceeds a predetermined corresponding threshold value.

16. The method according to claim 15, wherein the determining whether supplied unburnt fuel is in an excessive state includes computing the component ratio of the unburnt fuel in the gas based on one of an amount of the supplied unburnt fuel to the NOx catalytic converter and an unburnt fuel concentration in the gas in the exhaust system.

17. The method according to claim 14, wherein:

the determining whether supplied unburnt fuel is in an excessive state includes computing the one of the amount of the unburnt fuel and the unburnt fuel concentration based on the amount of the added and supplied unburnt fuel, which is added and supplied by the fuel adding.

18. The method according to claim 10, wherein:

the determining of the purifying performance includes measuring, with at least one oxygen concentration sensor, an oxygen concentration in the exhaust gas;

providing the at least one of the at least one oxygen concentration sensor on a downstream side of the NOx catalytic converter;

the determining of the purifying performance includes determining that the deoxidizing of the absorbed NOx at the NOx catalytic converter is completed when the determining of the purifying performance senses that the NOx deoxidizing agent begins to flow out of the NOx catalytic converter after initiation of the supplying and controlling of the NOx deoxidizing agent to the NOx catalytic converter based on a measurement of the at least one oxygen concentration sensor; and the determining of the purifying performance includes determining the purifying performance of the NOx catalytic converter based on a required time period that is required to complete the deoxidizing of the absorbed NOx since the initiation of the supplying and controlling of the NOx deoxidizing agent.

* * * * *